US011647349B2

(12) United States Patent
Xi et al.

(10) Patent No.: US 11,647,349 B2
(45) Date of Patent: May 9, 2023

(54) DISPLAY DEVICE, METHOD FOR REALIZING PANORAMIC SOUND THEREOF, AND NON-TRANSITORY STORAGE MEDIUM

(71) Applicants: Beijing BOE Optoelectronics Technology Co., Ltd., Beijing (CN); BOE Technology Group Co., Ltd., Beijing (CN)

(72) Inventors: Yanhui Xi, Beijing (CN); Xiaomang Zhang, Beijing (CN); Zhihua Ji, Beijing (CN); Tiankuo Shi, Beijing (CN); Yan Sun, Beijing (CN); Shuo Zhang, Beijing (CN); Xiangjun Peng, Beijing (CN); Yifan Hou, Beijing (CN); Chenxi Zhao, Beijing (CN); Minglei Chu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/485,116

(22) Filed: Sep. 24, 2021

(65) Prior Publication Data

US 2022/0095070 A1 Mar. 24, 2022

(30) Foreign Application Priority Data

Sep. 24, 2020 (CN) ..... 202011015365.3

(51) Int. Cl.

| | |
|---|---|
| ***H04S 7/00*** | (2006.01) |
| ***H04R 5/02*** | (2006.01) |
| ***H04R 5/04*** | (2006.01) |

(52) U.S. Cl.

CPC ..... *H04S 7/301* (2013.01); *H04R 5/02* (2013.01); *H04R 5/04* (2013.01); *H04R 2205/022* (2013.01); *H04R 2499/15* (2013.01)

(58) Field of Classification Search

None

See application file for complete search history.

(56) References Cited

U.S. PATENT DOCUMENTS

2008/0165992 A1* 7/2008 Kondo ..... H04N 7/0122 381/182

2016/0198282 A1* 7/2016 Kim ..... H04S 7/301 381/303

(Continued)

*Primary Examiner* — Duc Nguyen

*Assistant Examiner* — Assad Mohammed

(74) *Attorney, Agent, or Firm* — IPro, PLLC

(57) ABSTRACT

A display device, a method for realizing panoramic sound, a non-transitory storage medium are provided. The method includes: performing space model parameter modification on preset space model based on application environment; determining middle audio source information based on video source information as read, determining side audio source information based on video source information and modified space model parameter; determining top audio source information based on sound image position information and side audio source information; controlling middle sound production circuit to produce sound based on middle audio source information, two side sound production circuits to produce sound based on side audio source information, top sound production circuit to produce sound based on top audio source information.

19 Claims, 2 Drawing Sheets

(56) References Cited

U.S. PATENT DOCUMENTS

| | | | | |
|---|---|---|---|---|
| 2017/0127211 | A1* | 5/2017 | Crockett | H04R 5/02 |
| 2017/0156012 | A1* | 6/2017 | Yu | H04R 29/001 |
| 2017/0262073 | A1* | 9/2017 | Jung | H04N 21/439 |
| 2018/0035072 | A1* | 2/2018 | Asarikuniyil | H04N 21/4438 |
| 2020/0379508 | A1* | 12/2020 | Lee | H04R 9/066 |

* cited by examiner

DISPLAY DEVICE, METHOD FOR REALIZING PANORAMIC SOUND THEREOF, AND NON-TRANSITORY STORAGE MEDIUM

CROSS-REFERENCE TO RELATED APPLICATION

This application claims priority to Chinese Patent Application No. 202011015365.3 filed in China on Sep. 24, 2020, which is incorporated in its entirety by reference herein.

TECHNICAL FIELD

The present disclosure relates to the technical field of panoramic sound, and in particular to a display device, a method for realizing panoramic sound, and a non-transitory storage medium.

BACKGROUND

In recent years, consumers have been pursuing a more extreme audio-visual experience. The 5.1-channel surround sound can bring an experience of 360° sound field surround to an audience member. Panoramic sound refers to that two top speakers above a head of a viewer are added on the basis of 5.1-channel, to increase the sound image in the height direction so as to form a spherical sound field, which brings a more shocking effect to the audience member.

SUMMARY

A first aspect of the present disclosure provides a method for realizing panoramic sound for a display device. The display device includes a middle sound production circuit, two side sound production circuits and a top sound production circuit; in a horizontal direction, one of the two side sound production circuits is on a first side of the display device, the other of the two side sound production circuits is on a second side of the display device, and the middle sound production circuit is between the two side sound production circuits; the top sound production circuit is on a side of the display device where an upper frame is located, and a sound production surface of the top sound production circuit faces a sound blocker above a head of an audience member;

the method for realizing panoramic sound includes:

performing space model parameter modification on a preset space model, based on an application environment of the display device;

reading video source information to be displayed by the display device, determining middle audio source information corresponding to the middle sound production circuit according to the video source information, and determining side audio source information corresponding to the two side sound production circuits based on the video source information and a modified space model parameter;

determining sound image position information according to the video source information;

determining top audio source information corresponding to the top sound production circuit, according to the sound image position information and the side audio source information; and controlling the middle sound production circuit to produce sound based on the middle audio source information, controlling the two side sound production circuits to produce sound based on the side audio source information, and controlling the top sound production circuit to produce sound based on the top audio source information.

In some embodiments, the performing space model parameter modification on the preset space model based on the application environment of the display device includes:

playing a preset test audio source;

receiving reflected sound information of the test audio source, where the reflected sound information is formed by reflection of the application environment; and performing space model parameter modification on the preset space model according to the reflected sound information.

In some embodiments, the determining the middle audio source information corresponding to the middle sound production circuit includes:

obtaining audio information from the video source information; and separating the middle audio source information from the audio information directly;

where the determining the side audio source information corresponding to the two side sound production circuits includes:

calculating the side audio source information by using a virtual speaker technology, according to the audio information and the modified space model parameter.

In some embodiments, the method for realizing panoramic sound further includes:

obtaining basic surround sound audio source information;

fusing the basic surround sound audio source information with the side audio source information to obtain target surround sound information; and controlling the two side sound production circuits to produce sound based on the target surround sound information.

In some embodiments, the determining the sound image position information according to the video source information includes:

determining attribute information of a sound production source according to the video source information;

in a case that the attribute information indicates that the sound production source is in a display image of the display device, obtaining video information from the video source information, and determining the sound image position information using a neighbor frame difference method according to the video information; and in a case that the attribute information indicates that the sound production source is outside the display image of the display device, analyzing a change in sound intensity over time according to the video source information, and determining a distance between the sound production source and the audience member in real time to determine the sound image position information.

In some embodiments, the determining the top audio source information corresponding to the top sound production circuit according to the sound image position information and the side audio source information includes:

determining sound intensity information corresponding to the two side sound production circuits according to the side audio source information; and determining the top audio source information corresponding to the top sound production circuit, according to a conversion relationship between the sound image position information and the sound intensity information.

In some embodiments, n the display device further includes a bottom sound production circuit, and the bottom sound production circuit is on a side of the display device where a lower frame is located;

the method for realizing panoramic sound further includes:

obtaining audio information from the video source information;

separating bottom audio source information corresponding to the bottom sound production circuit from the audio information directly; and controlling the bottom sound production circuit to produce sound based on the bottom audio source information.

Based on the technical solution of the method for achieving panoramic sound for the display device, a second aspect of the present disclosure provides a display device, the display device includes a middle sound production circuit, two side sound production circuits and a top sound production circuit; where in a horizontal direction, one of the two side sound production circuits is on a first side of the display device, the other of the two side sound production circuits is on a second side of the display device, and the middle sound production circuit is between the two side sound production circuits; the top sound production circuit is on a side of the display device where an upper frame is located, and a sound production surface of the top sound production circuit faces a sound blocker above a head of an audience member;

the display device further includes:

a modification circuit, configured to perform space model parameter modification on a preset space model, based on an application environment of the display device;

an audio source information determining circuit, configured to read video source information to be displayed by the display device, determine middle audio source information corresponding to the middle sound production circuit according to the video source information, and determine side audio source information corresponding to the two side sound production circuits based on the video source information and a modified space model parameter; and a sound image position information determining circuit, configured to determine sound image position information according to the video source information;

where the audio source information determining circuit is further configured to determine top audio source information corresponding to the top sound production circuit, according to the sound image position information and the side audio source information;

where the middle sound production circuit is configured to produce sound based on the middle audio source information, the two side sound production circuits are configured to produce sound based on the side audio source information, and the top sound production circuit is configured to produce sound based on the top audio source information.

In some embodiments, the two side sound production circuits are configured to play a preset test audio source;

where the modification circuit includes:

a receiving sub-circuit, configured to receive reflected sound information of the test audio source, where the reflected sound information is formed by reflection of the application environment; and a modification sub-circuit, configured to perform space model parameter modification on the preset space model according to the reflected sound information.

In some embodiments, the audio source information determining circuit includes:

an obtaining sub-circuit, configured to obtain audio information from the video source information;

a separating sub-circuit, configured to separate the middle audio source information from the audio information directly; and a calculating sub-circuit, configured to calculate the side audio source information by using a virtual speaker technology, according to the audio information and the modified space model parameter.

In some embodiments, the display device further includes:

an obtaining circuit, configured to obtain basic surround sound audio source information; and a fusing sub-circuit, configured to fuse the basic surround sound audio source information with the side audio source information to obtain target surround sound information;

where the two side sound production circuits are configured to produce sound based on the target surround sound information.

In some embodiments, the sound image position information determining circuit is configured to:

determine attribute information of a sound production source according to the video source information;

in a case that the attribute information indicates that the sound production source is in a display image of the display device, obtain video information from the video source information, and determine the sound image position information using a neighbor frame difference method according to the video information; and in a case that the attribute information indicates that the sound production source is outside the display image of the display device, analyze a change in sound intensity over time according to the video source information, and determine a distance between the sound production source and the audience member in real time to determine the sound image position information.

In some embodiments, the audio source information determining circuit is configured to:

determine sound intensity information corresponding to the two side sound production circuits according to the side audio source information; and determine the top audio source information corresponding to the top sound production circuit, according to a conversion relationship between the sound image position information and the sound intensity information.

In some embodiments, the display device further includes a bottom sound production circuit, where the bottom sound production circuit is on a side of the display device where a lower frame is located, and the audio source information determining circuit includes:

an obtaining sub-circuit, configured to obtain audio information from the video source information; and a separating sub-circuit, configured to separate bottom audio source information corresponding to the bottom sound production circuit from the audio information directly;

where the bottom sound production circuit is configured to produce sound based on the bottom audio source information.

Based on the technical solution of the method for realizing the panoramic sound for the display device, a third aspect of the present disclosure provides a display device, including: a processor and a memory, where the memory stores instructions, and the instructions, when being executed by the processor, perform the method for realizing panoramic sound.

Based on the technical solution of the method for realizing panoramic sound for the display device, a fourth aspect of the present disclosure provides a non-transitory storage medium, having instructions stored thereon, where the instructions, when being executed by a processor, perform the method for realizing panoramic sound.

BRIEF DESCRIPTION OF THE DRAWINGS

The drawings described herein are used to provide a further understanding of the present disclosure and constitute a part of the present disclosure. The illustrative embodiments of the present disclosure and their descriptions are used to explain the present disclosure, and do not constitute an improper limitation of the present disclosure. In the drawings.

DETAILED DESCRIPTION

In order to further explain a display device, a method for realizing panoramic sound thereof, and a non-transitory storage medium provided by embodiments of the present disclosure, a detailed description is provided hereinafter in conjunction with the drawings of the specification.

Panoramic sound requires a sound field in three dimensions: horizontal dimension, depth dimension, and height dimension. Thus, taking the simplest 5.1.2 channel as an example, at least 8 speakers are required. However, a relatively large number of speakers not only have relatively high requirements for space, but also appear heavy as a whole. To experience a viewing effect with panoramic sound, a viewer needs to be in a movie theater or needs to install an expensive home theater system.

Embodiments of the present disclosure provide a display device, a method for realizing panoramic sound thereof, and a non-transitory storage medium, to achieve an experience of a viewing effect with panoramic sound in a case that the space is small and the device for realizing panoramic sound is ensured to be light.

Figure 1:
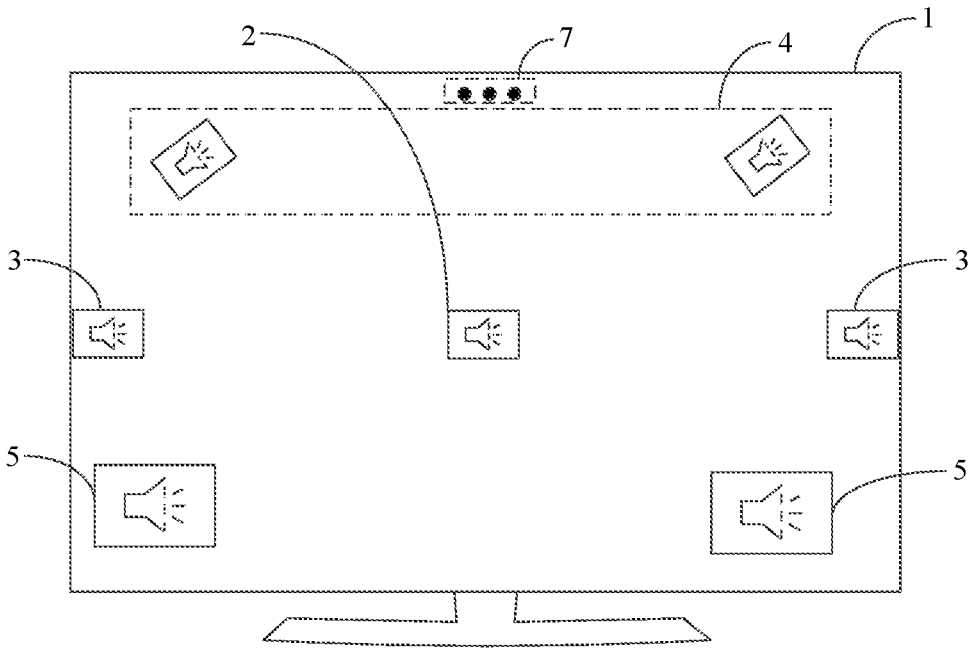
FIG. 1 is a schematic structural diagram of a display device provided by some embodiments of the disclosure.
Figure 2:
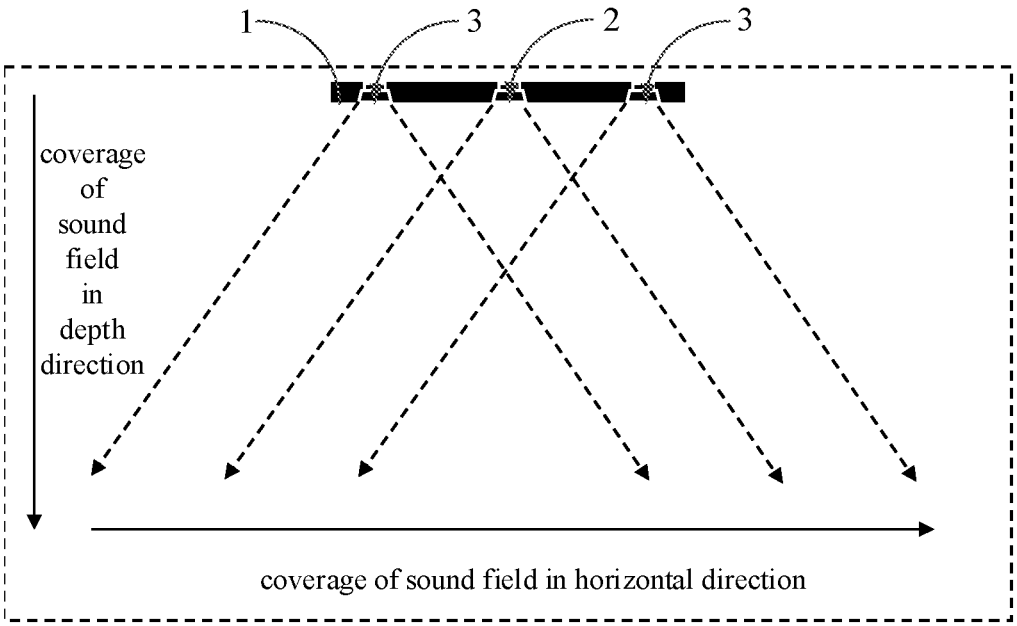
FIG. 2 is a schematic diagram of a range of a sound field in a horizontal direction and in a depth direction provided by some embodiments of the present disclosure.
Figure 3:
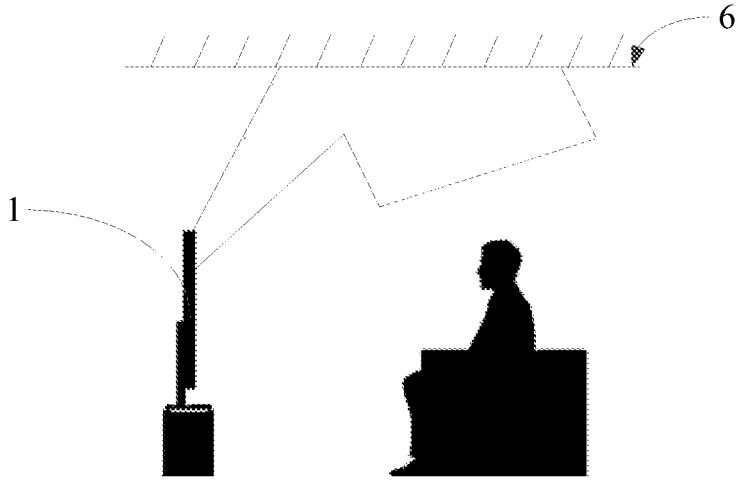
FIG. 3 is a schematic diagram of sound production of a top sound production circuit provided by some embodiments of the present disclosure.

Referring to FIGS. 1 to 3, some embodiments of the present disclosure provide a method for realizing panoramic sound for a display device 1. The display device 1 includes a middle sound production circuit 2, two side sound production circuits 3 and a top sound production circuit 4. In a horizontal direction, one of the two side sound production circuits 3 is on a first side of the display device 1, the other of the two side sound production circuits 3 is on a second side of the display device 1, and the middle sound production circuit 2 is between the two side sound production circuits 3; the top sound production circuit 4 is on a side of the display device 1 where an upper frame is located, and a sound production surface of the top sound production circuit 4 faces a sound blocker 6 above a head of an audience member.

The method for realizing panoramic sound includes:

performing space model parameter modification on a preset space model, based on an application environment of the display device 1;

reading video source information to be displayed by the display device 1, determining middle audio source information corresponding to the middle sound production circuit 2 according to the video source information, and determining side audio source information corresponding to the two side sound production circuits 3 based on the video source information and a modified space model parameter;

determining sound image position information according to the video source information;

determining top audio source information corresponding to the top sound production circuit 4, according to the sound image position information and the side audio source information; and controlling the middle sound production circuit 2 to produce sound based on the middle audio source information, controlling the two side sound production circuits 3 to produce sound based on the side audio source information, and controlling the top sound production circuit 4 to produce sound based on the top audio source information.

As shown in FIG. 1, for example, the middle sound production circuit 2 includes a first speaker located at a center of a display screen of the display device 1, and a sound production surface of the first speaker faces the audience member. For example, the middle sound production circuit 2 is configured to produce sound of dialogue, where the sound of dialogue includes voice of a character.

Exemplarily, the two side sound production circuits 3 include a second speaker and a third speaker, where the second speaker is located on the left side of the display screen, and the third speaker is located on the right side of the display screen.

Exemplarily, the first speaker, the second speaker, and the third speaker are located in a straight line in a horizontal direction. Exemplarily, the first speaker, the second speaker, and the third speaker are all full-range speakers.

As shown in FIG. 2, the first speaker, the second speaker, and the third speaker may realize a sound field in the horizontal direction and the depth direction.

As shown in FIG. 1, for example, the top sound production circuit 4 includes a fourth speaker and a fifth speaker. The fourth speaker is located at the upper left corner of the display screen, and the fifth speaker is located at the upper right corner of the display screen. The sound production surfaces of the fourth speaker and the fifth speaker face the sound blocker 6 located above a head of an audience member.

As shown in FIG. 3, for example, each of the fourth speaker and the fifth speaker has an upward opening angle. The sound waves emitted by the fourth speaker and the fifth speaker are reflected downward after meeting the ceiling, and enter the ears of the audience member, so that the sound field may cover the entire height of the space, achieving a sound field in the height direction.

Exemplarily, directions of sound production surfaces of the middle sound production circuit 2, the two side sound production circuits 3 and the top sound production circuit 4 may be adjusted; the opening angle between the sound production surface of the top sound production circuit 4 and the horizontal direction may be adjusted.

It should be noted that the number of speakers included in each of the middle sound production circuit 2, the two side sound production circuits 3 and the top sound production circuit 4, and positions of the various speakers may be set according to actual needs.

The preset space model may be supported by external resources, that is, a space model which has been built is introduced from the outside. When the display device 1 is used for the first time, or when the display device 1 is moved to a new application environment, environment configuration is required. Based on the actual application environment of the display device 1, space model parameter modification may be performed on the preset space model.

The video source information to be displayed by the display device 1 is read. For example, the video source information includes video information and audio information. The middle audio source information corresponding to the middle sound production circuit 2 is determined according to the audio information. According to the video source information and the modified space model parameter, the side audio source information corresponding to the two side sound production circuits 3 is calculated through Dolby virtual speaker technology.

The sound image position information includes: information about the sound production body in the video, in the height direction. According to the sound image position information and the side audio source information, the top audio source information corresponding to the top sound production circuit 4 may be calculated.

After obtaining the middle audio source information, the side audio source information and the top audio source information corresponding to the middle sound production circuit 2, the two side sound production circuits 3 and the top sound production circuit 4 respectively, the middle sound production circuit 2 may be controlled to produce sound based on the middle audio source information, the two side sound emitting circuits 3 may be controlled to produce sound based on the side audio source information, and the top sound emitting circuit 4 may be controlled to produce sound based on the top audio source information, simultaneously.

In the method for realizing panoramic sound for the display device 1 provided by the embodiments of the present disclosure, the middle sound production circuit 2, the two side sound production circuits 3 and the top sound production circuit 4 are arranged in the display device 1, and the middle audio source information corresponding to the middle sound production circuit 2 is determined according to the video source information; according to the video source information and the modified space model parameter, the side audio source information corresponding to the two side sound production circuits 3 is determined; according to the sound image position information and the side audio source information, the top audio source information corresponding to the top sound production circuit 4 is determined. In this way, the middle sound production circuit 2, the two side sound production circuits 3 and the top sound production circuit 4 can achieve combined sound production together. As a result, surrounding by sound field in three dimensions of the horizontal direction, the depth direction and the height direction is realized, providing an immersive panoramic sound experience for the audience member.

Moreover, in the method for realizing panoramic sound for the display device 1 provided by the embodiments of the present disclosure, the middle sound production circuit 2, the two side sound production circuits 3 and the top sound production circuit 4 are all provided in the display device 1. And there is no need to place additional peripheral speakers in the application environment. Therefore, with the method for realizing panoramic sound for the display device 1 provided by the embodiments of the present disclosure, a viewing effect with panoramic sound can be achieved while satisfying the condition of small space and the condition of ensuring the lightness of the device for realizing panoramic sound.

In addition, in the method for realizing panoramic sound for the display device 1 provided by the embodiments of the present disclosure, the top sound production circuit 4 in the display device 1 is located on the side of the display device 1 where the upper frame is located, and the sound production surface of the top sound production circuit 4 faces the sound blocker 6 above the head of the audience member. In this way, the sound field in the height direction formed by the top sound production circuit 4 is not limited to the screen size, so that the sound field in the height direction can cover the entire height of the application environment, realizing a real sound effect of panoramic sound.

In some embodiments, the step of performing space model parameter modification on the preset space model based on the application environment of the display device 1 specifically includes:

playing a preset test audio source in the display device 1;

receiving reflected sound information of the test audio source, where the reflected sound information is formed by reflection of the application environment; and performing space model parameter modification on the preset space model according to the reflected sound information.

Specifically, the preset test audio source is played through at least part of the sound production circuits in the display device 1, and the preset test audio source may include test audio sources of different channels.

Exemplarily, a microphone array 7 is arranged near the upper frame of the display device 1, and the microphone array 7 receives the reflected sound information formed by the reflection of the test audio source through the application environment. It should be noted that the number of microphones included in the microphone array 7 and the position for arranging the microphone array 7 may be set according to actual needs.

According to the reflected sound information received by the microphone array 7, parameters such as the size of the actual application environment and the positions of obstacles in the environment are determined, and space model parameter modification is performed on the preset space model based on these parameters.

It should be noted that the space model parameter that needs to be modified include the size of the environment and the positions of the obstacles in the environment, etc.; and according to a difference between the time when the test audio source is emitted and the time when the microphone array 7 receives the reflected sound information, and the propagation speed of the sound in the air, the size of the actual application environment and the positions of the obstacles may be calculated.

In the method for realizing panoramic sound for the display device 1 provided in the above embodiments, based on the reflected sound information, parameters such as the size of the actual application environment and the positions of the obstacles may be accurately calculated, and space model parameter modification may be performed on the preset space model.

In some embodiments, the step of determining the middle audio source information corresponding to the middle sound production circuit 2 specifically includes:

obtaining audio information from the video source information; and separating the middle audio source information from the audio information directly;

the step of determining the side audio source information corresponding to the two side sound production circuits 3 specifically includes:

calculating the side audio source information by using a virtual speaker technology, according to the audio information and the modified space model parameter.

Specifically, the video source information includes video information and audio information, and the middle audio source information may be directly separated from the audio information. Based on the audio information and the modified space model parameter, the side audio source information corresponding to the two side sound production circuits 3 may be calculated with Dolby virtual speaker technology.

In some embodiments, the method for realizing panoramic sound further includes:

obtaining basic surround sound audio source information;

fusing the basic surround sound audio source information with the side audio source information to obtain target surround sound information; and controlling the two side sound production circuits 3 to produce sound based on the target surround sound information.

Specifically, the basic surround sound audio source information may be pre-stored in the display device 1, or the video source information includes the basic surround sound audio source information.

Using the Dolby virtual speaker technology, the basic surround sound audio source information may be fused with the side audio source information to obtain target surround sound information; and the two side sound production circuits 3 emit sound based on the target surround sound information, achieving the effect of surround sound.

In some embodiments, the step of the determining the sound image position information according to the video source information specifically includes:

determining attribute information of a sound production source according to the video source information;

in a case that the attribute information indicates that the sound production source is in a display image of the display device 1, obtaining video information from the video source information, and determining the sound image position information using a neighbor frame difference method according to the video information; and in a case that the attribute information indicates that the sound production source is outside the display image of the display device 1, analyzing a change in sound intensity over time according to the video source information, and determining a distance between the sound production source and the audience member in real time to determine the sound image position information.

Specifically, when the audio information included in the video source information is non-panoramic sound audio information, the attribute information of the sound production source needs be determined first. When the attribute information indicates that the sound production source is in the display image of the display device 1, for example, the sound production source being a conversation between people, the video information is obtained from the video source information, and the sound image position information is determined based on the video information and with the neighbor frame difference method in the related technologies.

When the attribute information indicates that the sound production source is outside the display image of the display device 1, for example, the sound production source being background sound such as sound of wind and sound of rain, the change in sound intensity over time may be analyzed based on the video source information, so as to determine the distance between the sound production source and the audience member in real time to determine the sound image position information.

With the method for realizing panoramic sound for the display device 1 provided in the above embodiments, the position of the sound production source can be determined with reference to the video source information, and the sound image position information may be determined by selecting the corresponding method based on the different positions of the sound production source, bringing better immersion for the audience member.

In some embodiments, the step of determining the top audio source information corresponding to the top sound production circuit 4 according to the sound image position information and the side audio source information specifically includes:

determining sound intensity information corresponding to the two side sound production circuits 3 according to the side audio source information; and determining the top audio source information corresponding to the top sound production circuit 4, according to a conversion relationship between the sound image position information and the sound intensity information.

Specifically, the conversion relationship between the sound image position information and the sound intensity information may include that: every time the distance between the sound production source and the audience member is halved, the sound intensity increases by a certain decibel, for example, it may be specifically 6 decibels. Based on the sound intensity information and the conversion relationship, the top audio source information corresponding to the top sound production circuit 4 is determined.

In some embodiments, the display device 1 further includes a bottom sound production circuit 5, and the bottom sound production circuit 5 is on a side of the display device 1 where a lower frame is located;

the method for realizing panoramic sound further includes:

obtaining audio information from the video source information;

separating the bottom audio source information corresponding to the bottom sound production circuit 5 from the audio information directly; and controlling the bottom sound production circuit 5 to produce sound based on the bottom audio source information.

Exemplarily, the bottom sound production circuit 5 includes a sixth speaker and a seventh speaker, the sixth speaker is located at the lower left corner of the display device 1, and the seventh speaker is located at the lower right corner of the display device 1.

Exemplarily, the bottom sound production circuit 5 includes two peripheral subwoofers, and the two subwoofers are directly placed on the left and right sides of the display device 1. This solution has a lower cost and a better effect, and its disadvantage is that the device is not light enough.

Exemplarily, the bottom sound production circuit 5 adopts flat speakers, which are directly attached to the display screen and located on the left and right sides of the lower part of the screen. This solution is limited by the technology of flat speaker, the lower limit of low frequency is about 100 Hz, and the cost is relatively high. However, its advantage is that the display device 1 does not need to be connected with peripheral speakers, and the product is lighter and better meets the aesthetic requirements.

In the method for realizing panoramic sound for the display device 1 provided in the above embodiments, by providing the bottom sound production circuit 5, the power of the bass is increased, and the shocking of the entire sound field is enhanced.

In the method for realizing panoramic sound for the display device 1 provided in the above embodiments, the various pieces of audio source information as obtained may be transmitted to the corresponding sound production circuits respectively, and the panoramic sound can be realized by producing sound through the combination of the sound production circuits. While realizing panoramic sound, the display device 1 may display images simultaneously.

Some embodiments of the present disclosure also provide a display device 1. The display device 1 includes a middle sound production circuit 2, two side sound production circuits 3 and a top sound production circuit 4; where in a horizontal direction, one of the two side sound production circuits 3 is on a first side of the display device 1, the other of the two side sound production circuits 3 is on a second side of the display device 1, and the middle sound production circuit 2 is between the two side sound production circuits 3; the top sound production circuit 4 is on a side of the display device 1 where an upper frame is located, and a sound production surface of the top sound production circuit 4 faces a sound blocker 6 above a head of an audience member.

The display device 1 further includes:

a modification circuit, configured to perform space model parameter modification on a preset space model, based on an application environment of the display device 1;

an audio source information determining circuit, configured to read video source information to be displayed by the display device 1, determine middle audio source information corresponding to the middle sound production circuit 2 according to the video source information, and determine side audio source information corresponding to the two side sound production circuits 3 based on the video source information and a modified space model parameter; and a sound image position information determining circuit, configured to determine sound image position information according to the video source information;

the audio source information determining circuit is further configured to determine top audio source information corresponding to the top sound production circuit 4, according to the sound image position information and the side audio source information;

the middle sound production circuit 2 is configured to produce sound based on the middle audio source information, the two side sound production circuits 3 are configured to produce sound based on the side audio source information, and the top sound production circuit 4 is configured to produce sound based on the top audio source information.

It should be noted that the display device 1 may be any product or component with display and sound generation function, such as a TV or a monitor.

In the display device 1 provided by some embodiments of the present disclosure, the middle sound production circuit 2, the two side sound production circuits 3 and the top sound production circuit 4 are provided in the display device 1; the audio source information determining circuit determines the middle audio source information corresponding to the middle sound production circuit 2 according to the video source information, determines the side audio source information corresponding to the two side sound production circuits 3 according to the video source information and the modified space model parameter, and determines the top audio source information corresponding to the top sound production circuit 4 according to the sound image position information and the side audio source information. In this way, the middle sound production circuit 2, the two side sound production circuits 3 and the top sound production circuit 4 can achieve combined sound production together. As a result, surrounding by sound field in three dimensions of the horizontal direction, the depth direction and the height direction is realized, providing an immersive panoramic sound experience for the audience member.

Moreover, the middle sound production circuit 2, the two side sound production circuits 3 and the top sound production circuit 4 are all provided in the display device 1. And there is no need to place additional peripheral speakers in the application environment. Therefore, with the method for realizing panoramic sound for the display device 1 provided by the embodiments of the present disclosure, a viewing effect with panoramic sound can be achieved while satisfying the condition of small space and the condition of ensuring the lightness of the device for realizing panoramic sound.

In addition, the top sound production circuit 4 in the display device 1 is located on the side of the display device 1 where the upper frame is located, and the sound production surface of the top sound production circuit 4 faces the sound blocker 6 above the head of the audience member. In this way, the sound field in the height direction formed by the top sound production circuit 4 is not limited to the screen size, so that the sound field in the height direction can cover the entire height of the application environment, realizing a real sound effect of panoramic sound.

In some embodiments, the two side sound production circuits are configured to play a preset test audio source;

the modification circuit specifically includes:

a receiving sub-circuit, configured to receive reflected sound information of the test audio source, where the reflected sound information is formed by reflection of the application environment; and a modification sub-circuit, configured to perform space model parameter modification on the preset space model according to the reflected sound information.

In the display device 1 provided by the above embodiments, based on the reflected sound information, parameters such as the size of the actual application environment and the positions of the obstacles may be accurately calculated, and space model parameter modification may be performed on the preset space model.

In some embodiments, the audio source information determining circuit specifically includes:

an obtaining sub-circuit, configured to obtain audio information from the video source information;

a separating sub-circuit, configured to separate the middle audio source information from the audio information directly; and a calculating sub-circuit, configured to calculate the side audio source information by using a virtual speaker technology, according to the audio information and the modified space model parameter.

In some embodiments, the display device 1 further includes:

an obtaining circuit, configured to obtain basic surround sound audio source information; and a fusing sub-circuit, configured to fuse the basic surround sound audio source information with the side audio source information to obtain target surround sound information;

where the two side sound production circuits are configured to produce sound based on the target surround sound information.

Using the Dolby virtual speaker technology, the basic surround sound audio source information may be fused with the side audio source information to obtain target surround sound information; and the two side sound production circuits 3 emit sound based on the target surround sound information, achieving the effect of surround sound.

In some embodiments, the sound image position information determining circuit is specifically configured to:

determine attribute information of a sound production source according to the video source information;

in a case that the attribute information indicates that the sound production source is in a display image of the display device 1, obtain video information from the video source information, and determine the sound image position information using a neighbor frame difference method according to the video information; and in a case that the attribute information indicates that the sound production source is outside the display image of the display device 1, analyze a change in sound intensity over time according to the video source information, and determine a distance between the sound production source and the audience member in real time to determine the sound image position information.

With the display device 1 provided in the above embodiments, the position of the sound production source can be determined with reference to the video source information, and the sound image position information may be determined by selecting the corresponding method based on the different positions of the sound production source, bringing better immersion for the audience member.

In some embodiments, the audio source information determining circuit is specifically configured to:

determine sound intensity information corresponding to the two side sound production circuits 3 according to the side audio source information; and determine the top audio source information corresponding to the top sound production circuit 4, according to a conversion relationship between the sound image position information and the sound intensity information.

In some embodiments, the display device 1 further includes a bottom sound production circuit 5, where the bottom sound production circuit 5 is on a side of the display device 1 where a lower frame is located, and the audio source information determining circuit includes:

an obtaining sub-circuit, configured to obtain audio information from the video source information; and a separating sub-circuit, configured to separate bottom audio source information corresponding to the bottom sound production circuit 5 from the audio information directly;

where the bottom sound production circuit 5 is configured to produce sound based on the bottom audio source information.

In the display device 1 provided by the above embodiments, by providing the bottom sound production circuit 5, the power of the bass is increased, and the shocking of the entire sound field is enhanced.

In the display device 1 provided by the above embodiments, the various pieces of audio source information as obtained may be transmitted to the corresponding sound production circuits respectively, and the panoramic sound can be realized by producing sound through the combination of the sound production circuits. While realizing panoramic sound, the display device 1 may display images simultaneously.

Some embodiments of the present disclosure also provide a display device 1, including: a processor and a memory, where the memory stores computer executable instructions, and the computer executable instructions, when being executed by the processor, perform the method for realizing panoramic sound for the display device 1 according to the above embodiments.

Specifically, when the computer executable instructions are executed by the processor, the following steps are implemented:

performing space model parameter modification on a preset space model, based on an application environment of the display device 1;

reading video source information to be displayed by the display device 1, determining middle audio source information corresponding to the middle sound production circuit 2 according to the video source information, and determining side audio source information corresponding to the two side sound production circuits 3 based on the video source information and a modified space model parameter;

determining sound image position information according to the video source information;

determining top audio source information corresponding to the top sound production circuit 4, according to the sound image position information and the side audio source information; and controlling the middle sound production circuit 2 to produce sound based on the middle audio source information, controlling the two side sound production circuits 3 to produce sound based on the side audio source information, and controlling the top sound production circuit 4 to produce sound based on the top audio source information.

In some embodiments, when the computer executable instructions are executed by the processor, the following steps may also be implemented:

playing a preset test audio source;

receiving reflected sound information of the test audio source, where the reflected sound information is formed by reflection of the application environment; and performing space model parameter modification on the preset space model according to the reflected sound information.

In some embodiments, when the computer executable instructions are executed by the processor, the following steps may also be implemented:

obtaining audio information from the video source information; and separating the middle audio source information from the audio information directly;

the step of determining the side audio source information corresponding to the two side sound production circuits 3 specifically includes:

calculating the side audio source information by using a virtual speaker technology, according to the audio information and the modified space model parameter.

In some embodiments, when the computer executable instructions are executed by the processor, the following steps may be implemented:

obtaining basic surround sound audio source information;

fusing the basic surround sound audio source information with the side audio source information to obtain target surround sound information; and controlling the two side sound production circuits 3 to produce sound based on the target surround sound information.

In some embodiments, when the computer executable instructions are executed by the processor, the following steps may be implemented:

determining attribute information of a sound production source according to the video source information;

in a case that the attribute information indicates that the sound production source is in a display image of the display device 1, obtaining video information from the video source information, and determining the sound image position information using a neighbor frame difference method according to the video information; and in a case that the attribute information indicates that the sound production source is outside the display image of the display device 1, analyzing a change in sound intensity over time according to the video source information, and determining a distance between the sound production source and the audience member in real time to determine the sound image position information.

In some embodiments, when the computer executable instructions are executed by the processor, the following steps may be implemented:

determining sound intensity information corresponding to the two side sound production circuits 3 according to the side audio source information; and determining the top audio source information corresponding to the top sound production circuit 4, according to a conversion relationship between the sound image position information and the sound intensity information.

In some embodiments, when the computer executable instructions are executed by the processor, the following steps may be implemented:

obtaining audio information from the video source information;

separating bottom audio source information corresponding to the bottom sound production circuit 5 from the audio information directly; and controlling the bottom sound production circuit 5 to produce sound based on the bottom audio source information.

In the display device 1 provided by the embodiments of the present disclosure, the middle sound production circuit 2, the two side sound production circuits 3 and the top sound production circuit 4 are provided in the display device 1; the processor may determine the middle audio source information corresponding to the middle sound production circuit 2 according to the video source information, determine the side audio source information corresponding to the two side sound production circuits 3 according to the video source information and the modified space model parameter, and determine the top audio source information corresponding to the top sound production circuit 4 according to the sound image position information and the side audio source information. In this way, the middle sound production circuit 2, the two side sound production circuits 3 and the top sound production circuit 4 can achieve combined sound production together. As a result, surrounding by sound field in three dimensions of the horizontal direction, the depth direction and the height direction is realized, providing an immersive panoramic sound experience for the audience member.

Moreover, the middle sound production circuit 2, the two side sound production circuits 3 and the top sound production circuit 4 are all provided in the display device 1. And there is no need to place additional peripheral speakers in the application environment. Therefore, with the method for realizing panoramic sound for the display device 1 provided by the embodiments of the present disclosure, a viewing effect with panoramic sound can be achieved while satisfying the condition of small space and the condition of ensuring the lightness of the device for realizing panoramic sound.

In addition, the top sound production circuit 4 in the display device 1 is located on the side of the display device 1 where the upper frame is located, and the sound production surface of the top sound production circuit 4 faces the sound blocker 6 above the head of the audience member. In this way, the sound field in the height direction formed by the top sound production circuit 4 is not limited to the screen size, so that the sound field in the height direction can cover the entire height of the application environment, realizing a real sound effect of panoramic sound.

Some embodiments of the present disclosure also provide a non-transitory, non-volatile storage medium that stores computer executable instructions. When the computer executable instructions are executed by a processor, various processes of the method for realizing panoramic sound for the display device provided by the above embodiments are implemented and the same technical effects can be achieved, which are not repeated herein to avoid repetition. The storage medium includes a computer readable storage medium, such as a read-only memory (Read-Only Memory, ROM), a random access memory (Random Access Memory, RAM), a magnetic disk, or an optical disk.

Unless otherwise defined, the technical or scientific terms used in the present disclosure shall have the common meanings understood by those of ordinary skill in the art to which the present disclosure belongs. The terms "first", "second", and the like used in the present disclosure do not indicate any order, quantity, or importance, but are only used to distinguish different components. Word such as "including" or "having" means that the element or item listed before the word covers the element or item listed after the word and the equivalent thereof without excluding other elements or items. Word such as "connected" or "coupled" or "in communication" are not limited to physical or mechanical connection, but may include electrical connection, whether direct or indirect. "Up", "down", "left", "right", etc., are only used to indicate the relative position relationship. When the absolute position of the described object changes, the relative position relationship may change accordingly.

It can be understood that when an element such as a layer, film, region, or substrate is referred to as being "on" or "under" another element, the element may be directly "on" or "under" the another element, or there may be an intermediate element.

In the descriptions of the above embodiments, specific features, structures, materials, or characteristics may be combined in any one or more embodiments or examples in a suitable manner.

The above descriptions are only specific embodiments of the present disclosure, and the protection scope of the present disclosure is not limited thereto. Modifications or substitutions, easily made by any person skilled in the art within the technical scope of the present disclosure, fall within the protection scope of the present disclosure. Therefore, the protection scope of the present disclosure is defined by the protection scope of the claims.

What is claimed is:

1. A method for realizing panoramic sound for a display device, wherein the display device comprises a middle sound production circuit, two side sound production circuits and a top sound production circuit; in a horizontal direction, one of the two side sound production circuits is on a first side of the display device, the other of the two side sound production circuits is on a second side of the display device, and the middle sound production circuit is between the two side sound production circuits; the top sound production circuit is on a side of the display device where an upper frame is located, and a sound production surface of the top sound production circuit faces a sound blocker above a head of an audience member;

wherein the method for realizing panoramic sound comprises:

performing space model parameter modification on a preset space model, based on an application environment of the display device;

reading video source information to be displayed by the display device, determining middle audio source information corresponding to the middle sound production circuit according to the video source information, and determining side audio source information corresponding to the two side sound production circuits based on the video source information and a modified space model parameter;

determining sound image position information according to the video source information;

determining top audio source information corresponding to the top sound production circuit, according to the sound image position information and the side audio source information; and controlling the middle sound production circuit to produce sound based on the middle audio source information, controlling the two side sound production circuits to produce sound based on the side audio source information, and controlling the top sound production circuit to produce sound based on the top audio source information;

wherein the determining the middle audio source information corresponding to the middle sound production circuit comprises:

obtaining audio information from the video source information; and separating the middle audio source information from the audio information directly;

wherein the determining the side audio source information corresponding to the two side sound production circuits comprises:

calculating the side audio source information by using a virtual speaker technology, according to the audio information and the modified space model parameter.

2. The method for realizing panoramic sound for the display device according to claim 1, wherein the performing space model parameter modification on the preset space model based on the application environment of the display device comprises:

playing a preset test audio source;

receiving reflected sound information of the test audio source, wherein the reflected sound information is formed by reflection of the application environment; and performing space model parameter modification on the preset space model according to the reflected sound information.

3. The method for realizing panoramic sound for the display device according to claim 1, further comprising:

obtaining basic surround sound audio source information;

fusing the basic surround sound audio source information with the side audio source information to obtain target surround sound information; and controlling the two side sound production circuits to produce sound based on the target surround sound information.

4. The method for realizing panoramic sound for the display device according to claim 1, wherein the determining the sound image position information according to the video source information comprises:

determining attribute information of a sound production source according to the video source information;

in a case that the attribute information indicates that the sound production source is in a display image of the display device, obtaining video information from the video source information, and determining the sound image position information using a neighbor frame difference method according to the video information; and in a case that the attribute information indicates that the sound production source is outside the display image of the display device, analyzing a change in sound intensity over time according to the video source information, and determining a distance between the sound production source and the audience member in real time to determine the sound image position information.

5. The method for realizing panoramic sound for the display device according to claim 1, wherein the determining the top audio source information corresponding to the top sound production circuit according to the sound image position information and the side audio source information comprises:

determining sound intensity information corresponding to the two side sound production circuits according to the side audio source information; and determining the top audio source information corresponding to the top sound production circuit, according to a conversion relationship between the sound image position information and the sound intensity information.

6. The method for realizing panoramic sound for the display device according to claim 1, wherein the display device further comprises a bottom sound production circuit, and the bottom sound production circuit is on a side of the display device where a lower frame is located;

wherein the method for realizing panoramic sound further comprises:

separating bottom audio source information corresponding to the bottom sound production circuit from the audio information directly; and controlling the bottom sound production circuit to produce sound based on the bottom audio source information.

7. A display device, comprising a middle sound production circuit, two side sound production circuits and a top sound production circuit; wherein in a horizontal direction, one of the two side sound production circuits is on a first side of the display device, the other of the two side sound production circuits is on a second side of the display device, and the middle sound production circuit is between the two side sound production circuits; the top sound production circuit is on a side of the display device where an upper frame is located, and a sound production surface of the top sound production circuit faces a sound blocker above a head of an audience member;

wherein the display device further comprises:

a modification circuit, configured to perform space model parameter modification on a preset space model, based on an application environment of the display device;

an audio source information determining circuit, configured to read video source information to be displayed by the display device, determine middle audio source information corresponding to the middle sound production circuit according to the video source information, and determine side audio source information corresponding to the two side sound production circuits based on the video source information and a modified space model parameter; and a sound image position information determining circuit, configured to determine sound image position information according to the video source information;

wherein the audio source information determining circuit is further configured to determine top audio source information corresponding to the top sound production circuit, according to the sound image position information and the side audio source information;

wherein the middle sound production circuit is configured to produce sound based on the middle audio source information, the two side sound production circuits are configured to produce sound based on the side audio source information, and the top sound production circuit is configured to produce sound based on the top audio source information;

wherein the audio source information determining circuit comprises:

an obtaining sub-circuit, configured to obtain audio information from the video source information;

a separating sub-circuit, configured to separate the middle audio source information from the audio information directly; and a calculating sub-circuit, configured to calculate the side audio source information by using a virtual speaker technology, according to the audio information and the modified space model parameter.

8. The display device according to claim 7, wherein the two side sound production circuits are configured to play a preset test audio source;

wherein the modification circuit comprises:

a receiving sub-circuit, configured to receive reflected sound information of the test audio source, wherein the reflected sound information is formed by reflection of the application environment; and a modification sub-circuit, configured to perform space model parameter modification on the preset space model according to the reflected sound information.

9. The display device according to claim 7, further comprising:

an obtaining circuit, configured to obtain basic surround sound audio source information; and a fusing sub-circuit, configured to fuse the basic surround sound audio source information with the side audio source information to obtain target surround sound information;

wherein the two side sound production circuits are configured to produce sound based on the target surround sound information.

10. The display device according to claim 7, wherein the sound image position information determining circuit is configured to:

determine attribute information of a sound production source according to the video source information;

in a case that the attribute information indicates that the sound production source is in a display image of the display device, obtain video information from the video source information, and determine the sound image position information using a neighbor frame difference method according to the video information; and in a case that the attribute information indicates that the sound production source is outside the display image of the display device, analyze a change in sound intensity over time according to the video source information, and determine a distance between the sound production source and the audience member in real time to determine the sound image position information.

11. The display device according to claim 7, wherein the audio source information determining circuit is configured to:

determine sound intensity information corresponding to the two side sound production circuits according to the side audio source information; and determine the top audio source information corresponding to the top sound production circuit, according to a conversion relationship between the sound image position information and the sound intensity information.

12. The display device according to claim 7, further comprising a bottom sound production circuit, wherein the bottom sound production circuit is on a side of the display device where a lower frame is located, wherein the separating sub-circuit is further configured to separate bottom audio source information corresponding to the bottom sound production circuit from the audio information directly;

wherein the bottom sound production circuit is configured to produce sound based on the bottom audio source information.

13. A display device, comprising: a processor and a memory, wherein the memory stores instructions, and the instructions, when being executed by the processor, perform the method for realizing panoramic sound according to claim 1.

14. The display device according to claim 13, wherein the performing space model parameter modification on the preset space model based on the application environment of the display device comprises:

playing a preset test audio source;

receiving reflected sound information of the test audio source, wherein the reflected sound information is formed by reflection of the application environment; and performing space model parameter modification on the preset space model according to the reflected sound information.

15. The display device according to claim 13, wherein the method for realizing panoramic sound further comprises:

obtaining basic surround sound audio source information;

fusing the basic surround sound audio source information with the side audio source information to obtain target surround sound information; and controlling the two side sound production circuits to produce sound based on the target surround sound information.

16. The display device according to claim 13, wherein the determining the sound image position information according to the video source information comprises:

determining attribute information of a sound production source according to the video source information;

in a case that the attribute information indicates that the sound production source is in a display image of the display device, obtaining video information from the video source information, and determining the sound image position information using a neighbor frame difference method according to the video information; and in a case that the attribute information indicates that the sound production source is outside the display image of the display device, analyzing a change in sound intensity over time according to the video source information, and determining a distance between the sound production source and the audience member in real time to determine the sound image position information.

17. A non-transitory storage medium, having instructions stored thereon, wherein the instructions, when being executed by a processor, perform the method for realizing panoramic sound according to claim 1.

18. The display device according to claim 13, wherein the determining the top audio source information corresponding to the top sound production circuit according to the sound image position information and the side audio source information comprises:

determining sound intensity information corresponding to the two side sound production circuits according to the side audio source information; and determining the top audio source information corresponding to the top sound production circuit, according to a conversion relationship between the sound image position information and the sound intensity information.

19. The display device according to claim 13, wherein the display device further comprises a bottom sound production circuit, and the bottom sound production circuit is on a side of the display device where a lower frame is located;

wherein the method for realizing panoramic sound further comprises:

separating bottom audio source information corresponding to the bottom sound production circuit from the audio information directly; and controlling the bottom sound production circuit to produce sound based on the bottom audio source information.

* * * * *